US008561843B2

(12) United States Patent
Umenaka

(10) Patent No.: US 8,561,843 B2
(45) Date of Patent: Oct. 22, 2013

(54) SPOUT AND CONTAINER WITH SPOUT

(75) Inventor: Kazuhiro Umenaka, Fujimino (JP)

(73) Assignee: Hosokawa Yoko Co., Ltd., Tokyo (JP)

( * ) Notice: Subject to any disclaimer, the term of this patent is extended or adjusted under 35 U.S.C. 154(b) by 0 days.

(21) Appl. No.: 13/393,717

(22) PCT Filed: Sep. 3, 2010

(86) PCT No.: PCT/JP2010/065140

§ 371 (c)(1),
(2), (4) Date: Mar. 1, 2012

(87) PCT Pub. No.: WO2011/027860

PCT Pub. Date: Mar. 10, 2011

(65) Prior Publication Data

US 2012/0152984 A1 Jun. 21, 2012

(30) Foreign Application Priority Data

Sep. 4, 2009 (JP) ..... 2009-204693

(51) Int. Cl.
*B67B 1/00* (2006.01)

(52) U.S. Cl.
USPC ..... 222/80; 222/153.07; 222/92; 222/541.9; 222/572

(58) Field of Classification Search
USPC ..... 222/541.6, 566, 541.9, 92, 107, 80, 222/153.05–153.07, 541.1, 572; 220/265–266; 215/249, 253; 383/200, 383/202, 207, 209
See application file for complete search history.

(56) References Cited

U.S. PATENT DOCUMENTS

| | | | | |
|---|---|---|---|---|
| 3,189,227 | A * | 6/1965 | Hobbs et al. | 222/94 |
| 4,454,979 | A * | 6/1984 | Ikeda et al. | 383/10 |
| 4,718,778 | A | 1/1988 | Ichikawa | |
| 4,797,309 | A * | 1/1989 | Kammerer et al. | 428/35.3 |
| 5,228,782 | A * | 7/1993 | Imer | 383/200 |
| 5,238,157 | A * | 8/1993 | Gentile | 222/541.5 |
| 5,535,885 | A * | 7/1996 | Daniel et al. | 206/484 |

(Continued)

FOREIGN PATENT DOCUMENTS

| | | |
|---|---|---|
| JP | 61-137539 U | 8/1986 |
| JP | 10-007157 A | 1/1998 |

(Continued)

OTHER PUBLICATIONS

Machine english translation of JP 2008302941.*

(Continued)

*Primary Examiner* — Paul R. Durand
*Assistant Examiner* — Randall Gruby
(74) *Attorney, Agent, or Firm* — Sughrue Mion, PLLC

(57) ABSTRACT

A spout (20) which attaches to a container body (10), wherein the spout (20) is provided with a spout body (21), and a closing portion (22) which closes a discharge port of the aforementioned spout body (21); the aforementioned spout body (21) has an attachment (24) which is attached to a container body (10) in a liquid-tight manner, and an outer cylinder (25) which is positioned on the outer side of the container body (10); and the closing portion (22) is connected to a discharge port of the outer cylinder (25) in a manner which enables it to be snapped off, and is provided with projections (29) which extend toward the spout body (21) side. In addition, there is a spouted container (1) to which the aforementioned spout (20) is attached.

1 Claim, 10 Drawing Sheets

(56) References Cited

U.S. PATENT DOCUMENTS

| | | | | | |
|---|---|---|---|---|---|
| 5,937,617 | A | * | 8/1999 | Yeager | 53/412 |
| 5,957,584 | A | * | 9/1999 | Lakey | 383/5 |
| 6,076,664 | A | * | 6/2000 | Yeager | 206/217 |
| 6,126,315 | A | * | 10/2000 | Ichikawa et al. | 383/43 |
| 6,174,083 | B1 | * | 1/2001 | Delefortrie et al. | 383/200 |
| 6,551,819 | B1 | * | 4/2003 | Simmet | 435/307.1 |
| 6,991,140 | B2 | * | 1/2006 | Bourque et al. | 222/541.9 |
| 7,866,886 | B2 | * | 1/2011 | Kurosawa et al. | 383/44 |
| 2003/0012851 | A1 | * | 1/2003 | Kuge et al. | 426/85 |
| 2009/0097779 | A1 | * | 4/2009 | Branch | 383/5 |
| 2010/0086243 | A1 | | 4/2010 | Takeda et al. | |

FOREIGN PATENT DOCUMENTS

| | | | | |
|---|---|---|---|---|
| JP | 11-130153 | A | | 5/1999 |
| JP | 3061374 | U | | 9/1999 |
| JP | 2005-162323 | A | | 6/2005 |
| JP | 2005-162324 | A | | 6/2005 |
| JP | 2005-298008 | A | | 10/2005 |
| JP | 2007-076696 | A | | 3/2007 |
| JP | 2007-076747 | A | | 3/2007 |
| JP | 2008-302941 | A | | 12/2008 |
| JP | 2008-308206 | A | | 12/2008 |
| JP | 2008302941 | A | * | 12/2008 |
| JP | 2009-190781 | A | | 8/2009 |
| WO | WO 2008/149896 | A1 | | 12/2008 |

OTHER PUBLICATIONS

International Search Report of PCT/JP2010/065140 dated Nov. 16, 2010.

* cited by examiner

POUT AND CONTAINER WITH SPOUT

TECHNICAL FIELD

The present invention relates to a spout and a spouted container.

Priority is claimed on Japanese Patent Application No. 2009-204693, filed Sep. 4, 2009, the content of which is incorporated herein by reference.

BACKGROUND ART

As containers enclosing beverages, liquid detergent and the like, spouted containers have heretofore been widely used which have a container body, and a spout that discharges contents from the aforementioned container body. For example, the following spouted containers are known.

(i) A spouted container wherein a capped spout is attached in a liquid-tight manner to a container body (e.g., Patent Document 1).

(ii) A spouted container wherein a spout, in which a closing portion that closes a discharge port is formed in a manner enabling snap-off, is attached in a liquid-tight manner to a container body so that the aforementioned closing portion is exposed to the exterior (e.g., Patent Document 2). The spouted container of (ii) allows discharge of contents within the container body by exposing the discharge port of the spout by snap-off of the aforementioned closing portion.

PRIOR ART REFERENCES

Patent Documents

Patent Document 1: Japanese Unexamined Utility Model Application, First Publication No. 61-137539

Patent Document 2: Japanese Unexamined Patent Application, First Publication No. H10-7157

Patent Document 3: Japanese Unexamined Patent Application, First Publication No. H11-130153

Patent Document 4: Japanese Unexamined Patent Application, First Publication No. 2008-302941

DISCLOSURE OF INVENTION

Problems that the Invention is to Solve

With respect to the spouted container (i), as the spout is composed of the two members of the spout body and the cap, there is the problem that cost is high for a container of single-use application where there is no particular need for reclosure.

The spouted container (ii) is advantageous in terms of cost, because the closing portion that closes the discharge port is formed at one time. However, with respect to the spouted container (ii), as the connecting portion of the discharge port and the closing portion is thin-walled in order to enable snap-off of the closing portion, there is the problem that it is difficult to ensure fully stable hygienic properties and barrier properties.

On the other hand, the following container is disclosed as a container for solving the problem of hygiene properties and barrier properties of a spouted container.

(iii) A spouted container wherein a bag body is provided which is divided into a sealed chamber and a storage chamber by a partition, and a spout is attached by thermal fusion to the aforementioned partition in a state where a discharge port that is closed by a closing implement is sealed within the sealed chamber (e.g., Patent Document 3).

However, with the spouted container (iii), in order to unseal the container, it is necessary to unseal the closing implement after first unsealing the sealed chamber. That is, there is the problem that a two-step operation is required.

In contrast, the following container has been disclosed as a container that enables unsealing of the sealed chamber and unsealing of the closing implement by conducting a single sequence of actions.

(iv) A spouted container wherein a spout, in which a closing portion that closes a discharge port is foamed with interposition of a thin-walled portion, is sealed by a sealed chamber composed of two strips of film forming a bag; the aforementioned sealed chamber can be unsealed by means of an unsealing auxiliary line; and an unsealing auxiliary plate that extends at least either to the left or the right at the aforementioned closing portion is provided above the aforementioned unsealing auxiliary line (e.g., Patent Document 4). Unsealing of the spouted container (iv) is conducted by partially unsealing the sealed chamber by tearing it from one end along the unsealing auxiliary line, after which the unsealing auxiliary plate is held from the outside of the sealed chamber, and the closing portion is twisted off to sever the sealed chamber as is.

However, even if unsealing of the spouted container (iv) is conducted by a single sequence of actions, there is the problem that the sealed chamber and the discharge port cannot both be unsealed at the same time. Moreover, with respect to the spouted container (iv), the sealed chamber is unsealed by twisting the closing portion, and by bringing the unsealing auxiliary plate of the closing portion into contact with the unsealing auxiliary line, but in cases where the bore of the spout is large, there is the problem that it is difficult to cut open the unsealing auxiliary line along its entire length.

The present invention was made in order to solve the foregoing problems, and its object is to offer a spout that attaches to a container body of a disposable container, where the aforementioned spout is inexpensive, and facilitates exposure of a discharge port.

Another object of the present invention is to offer an inexpensive spouted container that provides excellent hygienic properties and barrier properties, and that enables easy exposure of a discharge port at one time by a single sequence of actions.

Means for Solving the Problems

One aspect of the spout of the present invention is a spout for attachment to a container body, wherein the aforementioned spout is provided with a spout body which is attached to the aforementioned container body that stores contents, and which discharges contents from the aforementioned container body, and a closing portion which closes a discharge port of the aforementioned spout body; the aforementioned spout body has an attachment which is attached to the aforementioned container body in a liquid-tight manner, and an outer cylinder which is positioned on the outer side of the aforementioned container body; and the aforementioned closing portion is connected to a discharge port of the outer cylinder of the aforementioned spout body in a manner which enables it to be snapped off, and is provided with projections which extend toward the aforementioned spout body side.

One aspect of the spouted container of the present invention is a spouted container which has a container body that stores contents, the aforementioned spout that is attached to the aforementioned container body, and a sealed portion that seals the aforementioned outer cylinder and closing portion of the aforementioned spout with a bag-like film; wherein a weakened line that facilitates severance of the aforementioned sealed portion is formed so as to expose the outer cylinder of the aforementioned spout body at a position corresponding to distal ends of projections of the aforementioned closing portion in the aforementioned sealed portion.

Effects of the Invention

The spout of the present invention is a spout which attaches to a container body, which is inexpensive, and which has excellent hygienic properties. In addition, it enables easy exposure of a discharge port.

The spouted container of the present invention is inexpensive, and has excellent hygienic properties and barrier properties. In addition, it likewise enables easy exposure of a discharge port at one time in a single action.

BEST MODE FOR CARRYING OUT THE INVENTION

The present invention is described below by showing examples of embodiments of the spout and spouted container of the present invention.

(Spouted Container)

Figure 1:
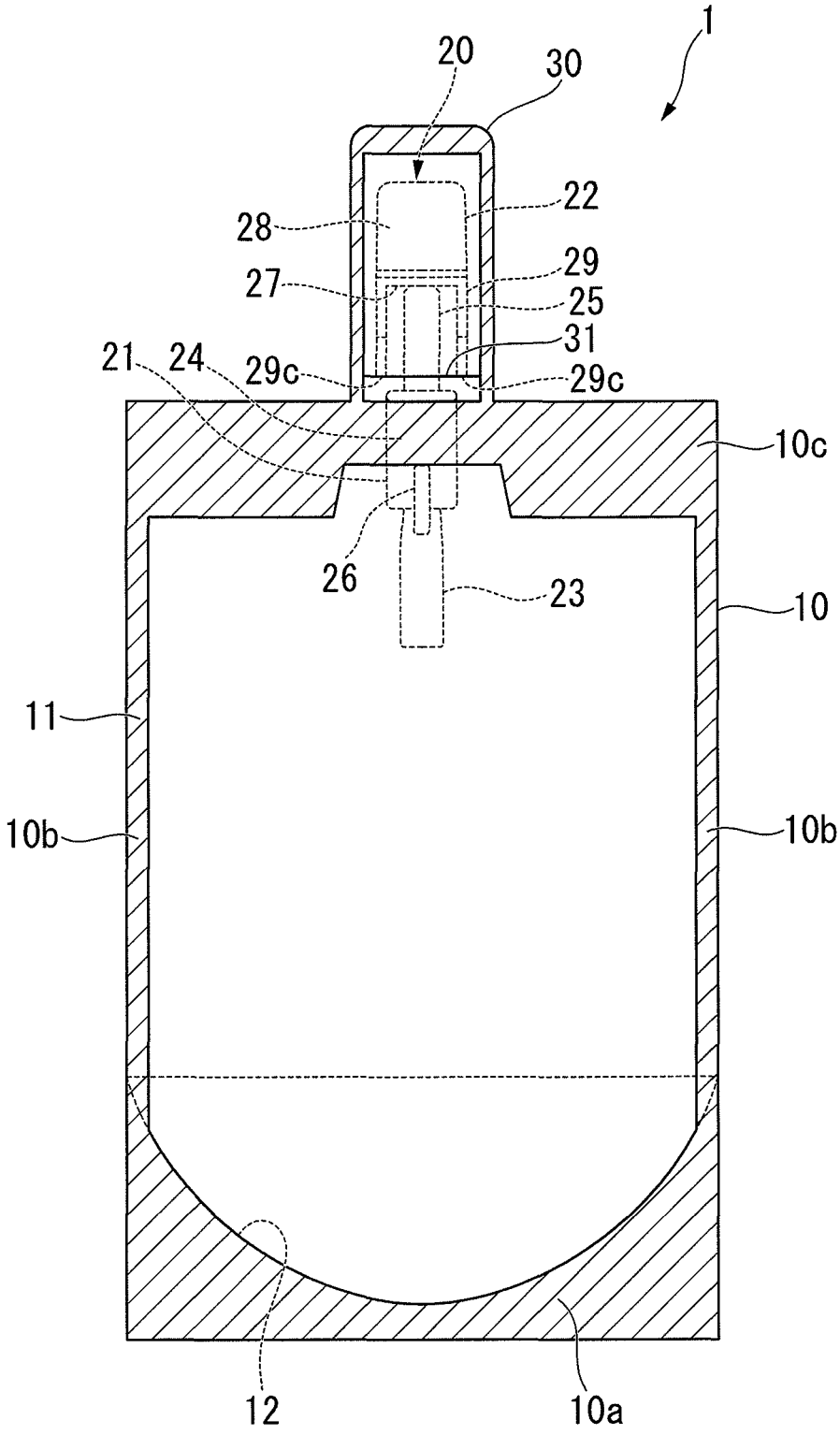
FIG. 1 is a front elevation view which shows one embodiment of the spouted container of the present invention.

As shown in FIG. 1, a spouted container 1 of the present embodiment has a container body 10 which is obtained by making film into bag form, and which stores contents, a spout 20 which is attached to the container body 10 in a liquid-tight manner, and which discharges contents from the container body 10, and a sealed portion 30 which is formed in bag form at the position where the spout 20 is attached to the container body 10, and which seals the portion of the spout 20 on the outer side of the container body 10.

(Container Body)

As shown in FIG. 1, the container body 10 is a standing bag which has a body portion 11 and a bottom 12 composed of film. The film which forms the body portion 11 and the film which forms the bottom 12 are welded with a bottom seal 10*a* and side edge seals 10*b*, 10*b* to form a concave bottom 12. The body portion 11 is welded at an upper seal 10*c*, and the spout 20 is attached in a liquid-tight manner at the upper seal 10*c*.

With respect to the film which foil is the body portion 11, a laminar film is preferable wherein at least a base layer and a sealant layer are laminated, and the innermost layer is the sealant layer.

With respect to the base layer, it is preferable to use a film which is provided with excellent printability, as well as piercing strength, tensile strength, impact resistance, and the like. For example, one may cite uniaxially-stretched film or biaxially-stretched film such as polyethylene terephthalate, polypropylene, polyamide, and ethylene vinyl alcohol copolymer. In addition, it is also acceptable to use vapor-deposited film on which metal such as aluminum and magnesium or oxide such as silicon oxide is vapor-deposited in order to impart barrier properties relative to oxygen and water vapor; coated film on which a barrier coating agent or the like such as polyvinylidine chloride is coated; and so on. The base layer may be a single body of the aforementioned film, or a laminar body.

The sealant layer is a layer composed of a film capable of heat sealing. As a film capable of heat sealing, one may use, for example, unstretched film such as high-density polyethylene, low-density polyethylene, linear low-density polyethylene, and polypropylene, as well as film in which the aforementioned resin is extruded in laminar form.

The laminar film may also have an intermediate layer between the base layer and the sealant layer, as necessary.

The intermediate layer uses, for example, film provided with functional properties such as oxygen barrier properties, water-vapor barrier properties, and tearability. Specifically, for example, metal foil such as aluminum may be used, as well as the aforementioned vapor-deposition film or coated film.

The laminar film composed of a base layer, a sealant layer, and an intermediate layer that is used as necessary may be manufactured by conventional methods such as a dry lamination method using adhesive, or an extrusion lamination method using thermobonding resin.

The film forming the body portion 11 may be a single-layer film composed of film capable of heat sealing.

The film that forms the bottom 12 uses the same material as the film that forms the body portion 11. The film that forms the bottom 12 and the film that forms the body portion 11 may be identical or different. Furthermore, in order to facilitate heat sealing of the mated films, it is preferable that they both be laminar film having sealant layers composed of the same type of resin.

The form of the container body of the spouted container of the present invention is not limited to the container body 10 described above, and there are no particular limitations provided that the spout 20 is attached thereto in a liquid-tight manner.

For example, the container body 10 may be a standing bag, wherein the film that forms the cylindrical body portion 11 and the film that forms the bottom 12 are welded onto the cylindrical inner surface of the body portion 11 and the two side faces of the bottom 12 with use of joining members that have heat sealing properties on both sides, and wherein the mated inner surfaces of the film of the body portion 11 and the bottom 12 are welded at the lower end.

As the spouted container of the present invention is disposable, and does not require reclosure, there is no particular limitation on the capacity of the container body, but it is frequently set at 100-500 ml.

(Sealed Portion)

As shown in FIG. 1, in the spouted container 1 of the present embodiment, the sealed portion 30 composed of bag-like film is formed at the attachment position of the spout 20 on the outer side of the container body 10. That is, the sealed portion 30 and the body portion 11 of the container body 10 are formed with the same film. A sealed space is formed by heat sealing the peripheral edge of the sealed portion 30 in a state where the two film portions forming the sealed portion 30 overlap. A below-described closing portion 22 and outer cylinder 25 within the spout 20 are sealed on the inner side of the sealed portion 30.

As shown in FIG. 1, a weakened line 31 is formed in the sealed portion 30 at a position corresponding to distal ends 29*c*, 29*c* of projections 29, 29 in the below-described closing portion 22 of the spout 20. In the present embodiment, the weakened line 31 is linearly formed in the lateral direction on at least one side of the sealed portion 30.

Weakened lines 31 may be foamed at positions corresponding to both sides of the sealed portion 30, but if a weakened line 31 is formed on only one side of the sealed portion 30, the other side of the sealed portion 30 is not severed when the spout 20 is exposed by unsealing the sealed portion 30 along the weakened line 31, and the sealed portion 30 can be left in a state where it is connected to the container body 10, enabling prevention of occurrence of an unsealed piece that constitutes refuse.

In the case where it is desired to use the sealed portion 30 with complete separation, it is preferable to form weakened lines 31 on both sides of the sealed portion 30. After the spout 20 has been exposed, separation can be achieved by tearing the other weakened line 31 by hand.

The mode of the weakened line 31 is not limited to a mode of formation in the lateral direction provided that the sealed portion 30 can be unsealed by severance along a weakened line 31 corresponding to distal ends 29*c*, 29*c* of projections 29, 29. For example, the weakened line 31 may be diagonally formed relative to the lateral direction. Moreover, the weakened line is not limited to a linear faun, and may be given a curved form.

The weakened line 31 may be formed in a solid line, or it may be formed in a broken line. The weakened line 31 may be formed by a method which uses a laser such as a $CO_2$ laser, or a blade.

(Spout)

The spout 20 of the present embodiment attaches to the container body which stores contents, and discharges the contents from the aforementioned container body. As shown in FIG. 2 to FIG. 4C, it is provided with a spout body 21 and a closing portion 22.

The spout body 21 has an insert 23 which inserts into the container body 10, an attachment 24 which attaches in a liquid-tight manner to the container body 10, and an outer cylinder 25 which is positioned on the outer side of the container body 10. Also formed is a flow-through portion 21*a* which transits the interior of the insert 23, attachment 24 and outer cylinder 25, and through which the contents of the container body 10 flow, and a discharge port 21*b* which discharges the contents that transit the flow-through portion 21*a* at the end of the outer cylinder 25. In addition, slit-like apertures 26, 26 are formed at the end of the insert 23 of the spout body 21 on the attachment 24 side.

By forming the insert 23 in the spout body 21, the insert 23 functions as a spacer, and is able to prevent contact of the mated inner surfaces of the film in the vicinity of the spout 20 of the container body 10. In short, for example, when contents within the container body 10 are drawn through the spout 20, the body portion 11 of the container body 10 narrows as the quantity of contents decreases in conjunction with suction. However, if there is an insert 23, contact of the mated inner surfaces of the film of the container body 10 is obstructed by having the insert 23 constitute a spacer. Accordingly, it is possible to inhibit reduction of space in the vicinity of the attachment position of the spout 20 in the body portion 11 of the container body 10, and obstruction of the suction of contents.

It is acceptable if the length of the insert 23 is a length that is accommodated by the container body 10 into which it is inserted, and this length will also vary according to the form of the container body 10, but it is preferable that it be 10-80% relative to the vertical length of the container body 10. If the length of the insert 23 is within the aforementioned range, it facilitates prevention of contact of the mated inner surfaces of the film of the body portion 11 of the container body 10, and assurance of adequate space for purposes of rapid discharge of contents.

In the insert 23, mutually opposed slit-like apertures 26, 26 are formed in the lengthwise direction of the insert 23 from the end on the attachment 24 side. That is, three apertures are formed in the insert 23: an aperture 21*c* at the end of the insert 23 which is the terminus of the flow-through portion 21*a*, and the aforementioned apertures 26, 26. By forming the apertures 26, 26, it is possible to inhibit contents from remaining in the vicinity of the insert 23 inside the container body 10.

It is sufficient if the length and width of the aperture 26 are a length and width which allow contents to flow into the flow-through portion 21*a* from the aperture 26, and be rapidly discharged. Here, the width of the aperture 26 signifies the length along the outer circumference in the case where the insert 23 does not have an aperture.

In the present embodiment, the number of apertures 26 is two, but the number of apertures 26 is not limited to two. For example, one aperture 26 is acceptable, and three or more are also acceptable. In the case where the insert 23 is short, the aperture(s) 26 may be eliminated altogether if bore diameter is small.

Moreover, the form of the aperture(s) 26 is not limited to a slit-like form, and any form that allows contents to rapidly flow into the flow-through portion 21*a* is acceptable. For example, an aperture of circular form or the like is also acceptable.

The attachment 24 of the present embodiment is the site where joining occurs with the film at the attachment position of the spout 20 in the container body 10. That is, at the attachment position of the spout 20 in the upper part of the container body 10, the attachment 24 of the spout body 21 is interposed between the film forming the container body 10, and the spout 20 is attached in a liquid-tight manner to the container body 10 by heat sealing the film and the attachment 24.

There are no particular limitations on the form of the attachment 24, but it is preferable to have a form that enables heat sealing to be easily conducted when the attachment 24 and the film at the upper part of the body portion 11 of the container body 10 are bonded by welding. In the present embodiment, as shown in FIG. 4C, the form is such that protrusions 24*a*, 24*a* are formed which extend widthwise on both sides in an approximately triangular cross-section from the cylindrical portion formed by the flow-through portion 21*a*. If the attachment 24 has the aforementioned form, liquid-tight attachment of the spout 20 by heat sealing is facilitated compared to the case where the attachment 24 has a cylindrical form.

The outer cylinder 25 is a portion of the spout body 21 which is positioned outside of the container body 10. For example, by placing one's mouth on the outer cylinder 25, and sucking from the discharge port 21*b*, it is possible to easily drink contents such as a beverage stored in the container body 10.

There are no particular limitations on the form of the outer cylinder 25, but a cylindrical form is preferable from the standpoint of facilitating application to the mouth for drinking purposes. It is preferable that the length of the outer cylinder 25 be 0.5-3.0 cm from the standpoint of facilitating application to the mouth.

The closing portion 22 closes the discharge port 21*b* of the spout body 21. The closing portion 22 is coupled to the discharge port 21*b* of the outer cylinder 25 via a thin-walled portion 25*a* in a manner that enables it to be snapped off from the spout body 21.

Figure 3A:
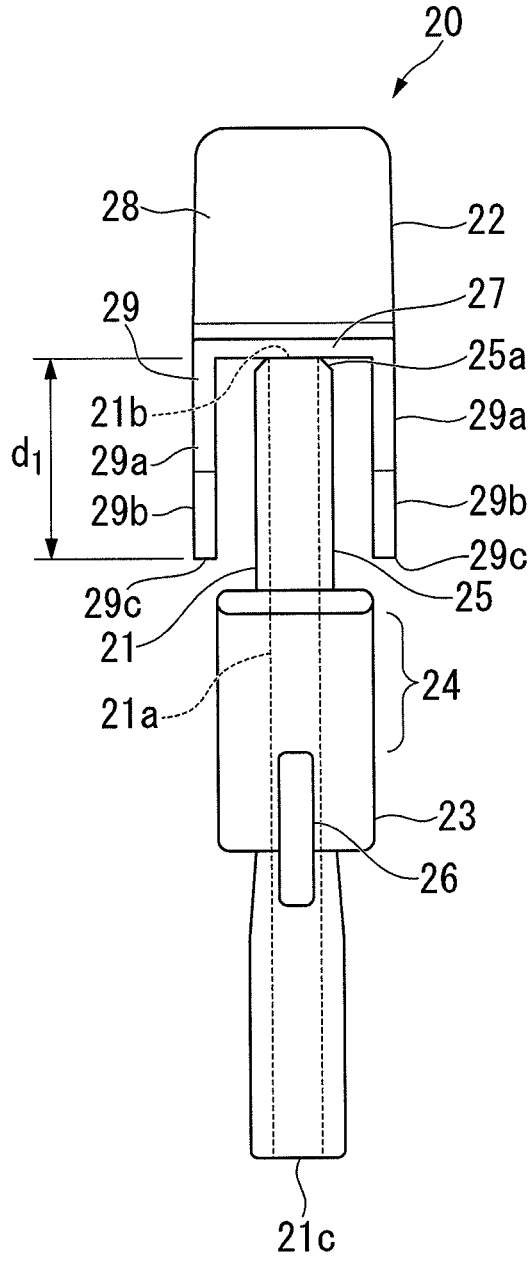
FIG. 3A is a front elevation view of the spout of FIG. 2.
Figure 3B:
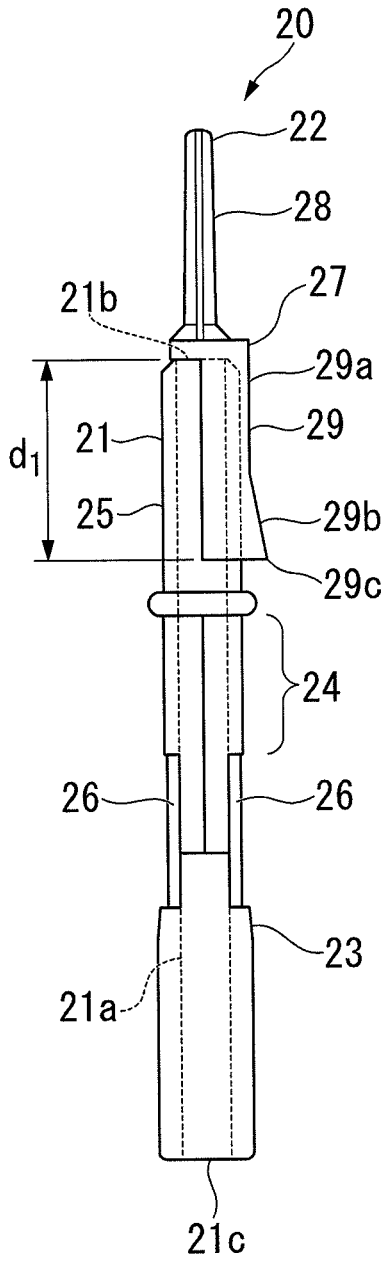
FIG. 3B is a side elevation view of the spout of FIG. 2.

With respect to the closing portion 22, as shown in FIG. 3A and FIG. 3B, a holder 28 constituted by a tabular piece that runs widthwise is formed on top of a tabular closing body 27 that is vertical in the lengthwise direction of the spout body 21. Furthermore, from the two edges in the widthwise direction of the surface of the closing body 27 on the outer cylinder 25 side, projections 29, 29 composed of tabular pieces extending toward the spout body 21 side are formed so as to face each other.

The closing portion 22 can be easily snapped off from the spout body 21 via the thin-walled portion 25*a* by gripping the holder 28, and pressing it downward. The form of the holder 28 is not limited to a tabular shape provided that the form enables easy snap-off of the closing portion 22 by gripping the holder 28, and a rod-like shape or the like is also acceptable.

Figure 2:
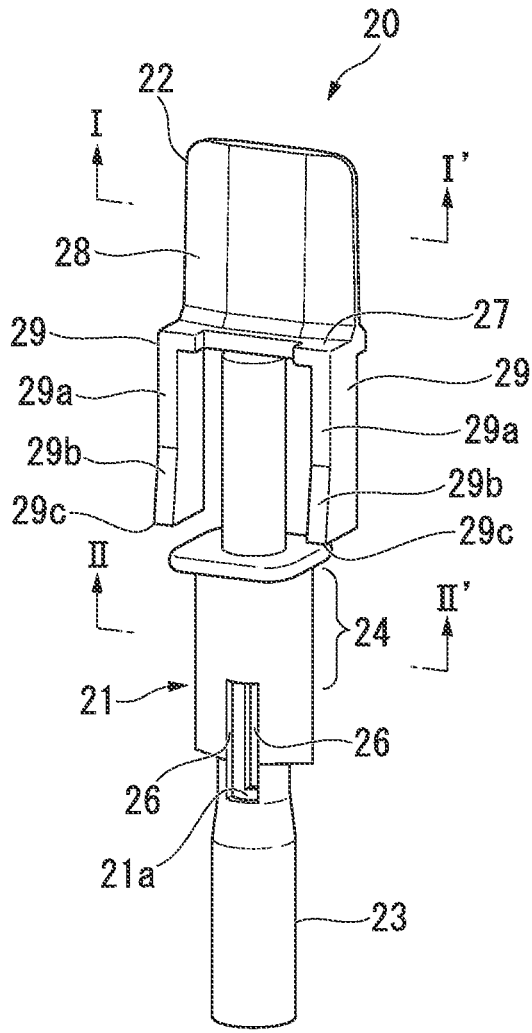
FIG. 2 is a perspective view which shows one embodiment of the spout of the present invention.

The projections 29, 29 are portions which sever the weakened line 31 of the sealed portion 30 in conjunction with snap-off of the closing portion 22. As shown in FIG. 2, the projections 29, 29 are tabular pieces which each vertically extend from the surface of the closing body 27 on the outer cylinder 25 side, and are sequentially constituted from base ends on the closing body 27 side by a first projection 29*a* whose width has the same rectangular shape, and by a second projection 29*b* of trapezoidal shape whose width gradually increases so that it protrudes forward as the distal end 29*c* side is approached. As shown in FIG. 1, the distal end 29*c* of the projection 29 corresponds to the position of the weakened line 31 of the sealed portion 30. Moreover, the distal end 29*c* of the projection 29 is not limited to a form that projects forward, but may also have a form that projects rearward as well.

The weakened line 31 of the sealed portion 30 is severed as described below by the projections 29, 29, thereby unsealing the sealed portion 30.

Figure 5:
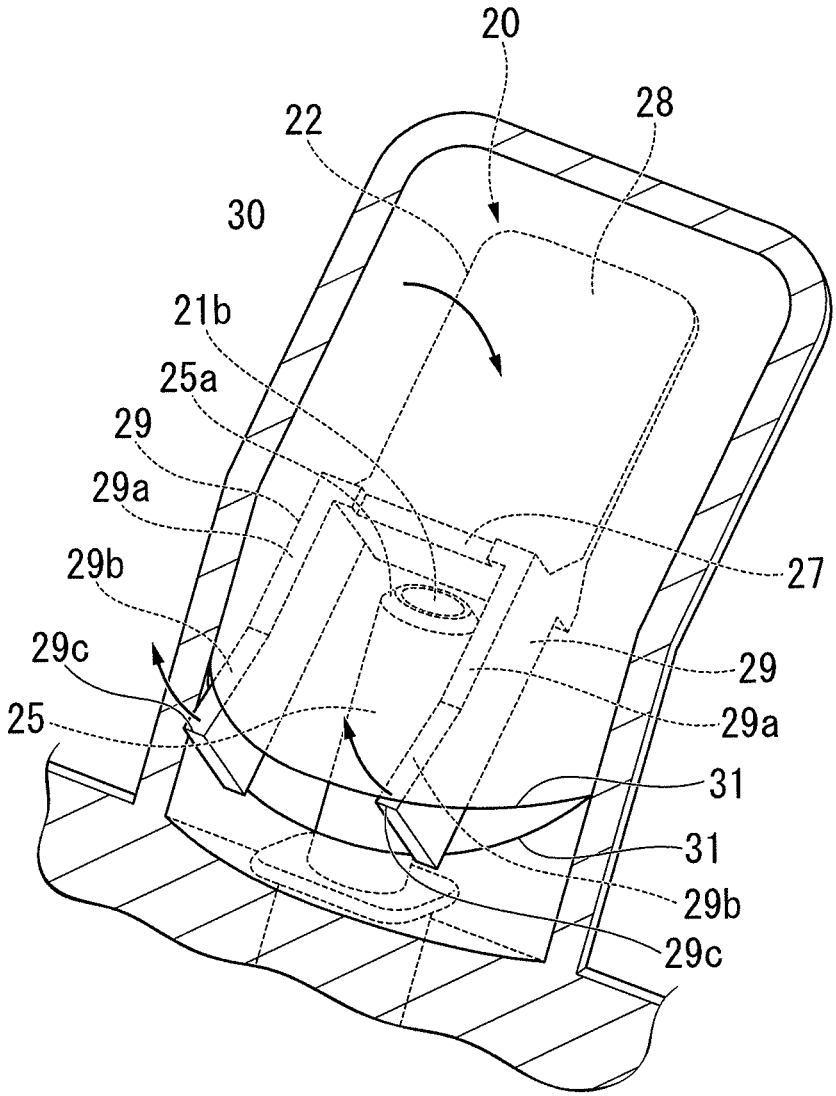
FIG. 5 is a perspective view which shows the state where the sealed portion has been unsealed by snapping off the closing portion of the spout in the spouted container of FIG.

With respect to the spout 20, the outer cylinder 25 of the spout body 21 and the closing portion 22 are sealed by the sealed portion 30. As shown in FIG. 5, when the closing portion 22 is snapped off to open the discharge port 21*b* of the spout body 21, the projections 29, 29 are simultaneously thrust forward—i.e., toward the weakened line 31—when the holder 28 is gripped from outside of the sealed portion 30, and the closing portion 22 is brought down rearward. The distal ends 29*c*, 29*c* of the two projections 29, 29 which are positioned on both sides of the outer cylinder 25 contact the weakened line 31, and break through the film of the sealed portion 30, thereby unsealing the sealed portion 30, and exposing the spout 20 in a state where the discharge port 21*b* is open.

The length $d_1$ of the projection 29 is shorter than the outer cylinder 25. The weakened line 31 is formed according to the length of the projection 29 so as to correspond to the distal end 29*c*.

In the present embodiment, projections 29, 29 composed of tabular pieces are shown, but the form thereof is not limited to the aforementioned tabular piece, provided that it is able to break through the weakened line 31 of the sealed portion 30 to unseal the sealed portion 30 in conjunction with snap-off of the closing portion 22, and the number thereof is also not limited.

Figure 6A:
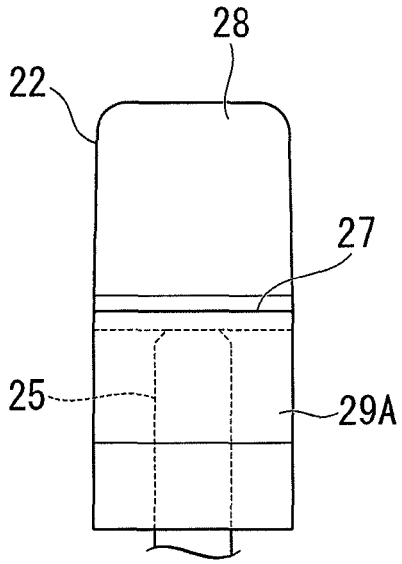
FIG. 6A is a front elevation view which shows another embodiment of the spout of the present invention.
Figure 6B:
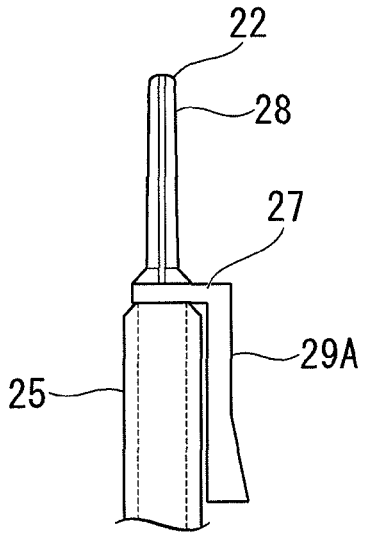
FIG. 6B is a side elevation view which shows another embodiment of the spout of the present invention.

For example, as shown in FIG. 6A and FIG. 6B, it is also acceptable to have a projection 29A which is composed of a single tabular piece having an inclined surface that vertically extends from the front edge of the surface of the closing body 27 on the outer cylinder 25 side—i.e., the edge on the weakened line 31 side—and that gradually protrudes forward from an intermediate point.

Figure 4A:
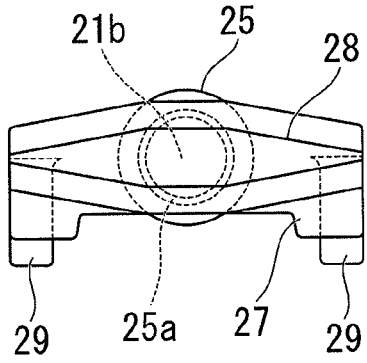
FIG. 4A is a plan view of the spout of FIG. 2.
Figure 4B:
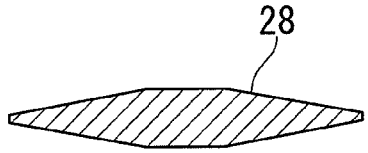
FIG. 4B is a cross-sectional view along line I-I' of the spout of FIG. 2.
Figure 4C:
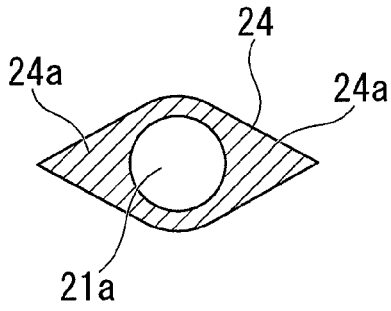
FIG. 4C is a cross-sectional view along line II-II' of the spout of FIG. 2.
Figure 7A:
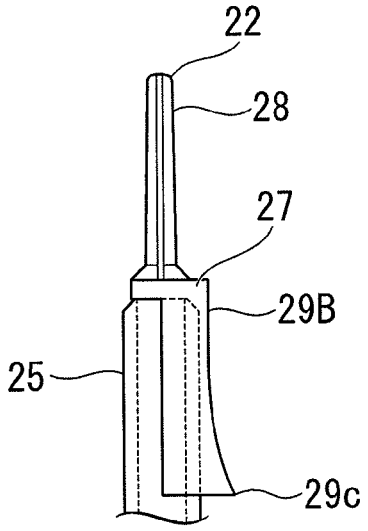
FIG. 7A is a side elevation view which shows another embodiment of the spout of the present invention.
Figure 7B:
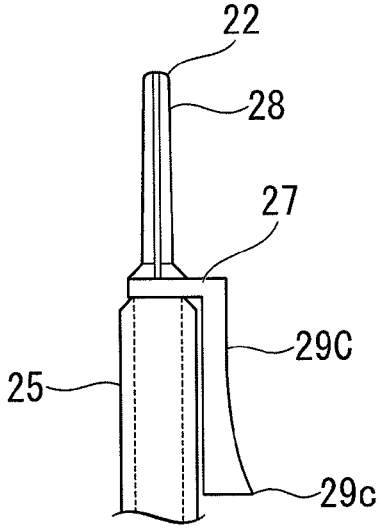
FIG. 7B is a side elevation view which shows another embodiment of the spout of the present invention.

In the case of projections composed of tabular pieces such as the projections 29 illustrated in FIG. 4A or the projection 29A illustrated in FIG. 6A and FIG. 6B, it is also acceptable to have, as shown in FIG. 7A and FIG. 7B, projections 29B, 29C whose distal ends 29*c* have a curved surface that protrudes forward, i.e., toward the weakened line 31. In addition, a projection composed of a tabular piece whose distal end 29*c* does not protrude forward is also acceptable.

One or two or more rod-shaped projection(s) is/are also acceptable.

Moreover, the projection(s) is/are not limited to a form which extends from the surface of the closing body 27 on the outer cylinder 25 side, as in the aforementioned closing portion 22. For example, it is also acceptable to have a form which first extends widthwise on both sides from the two widthwise sides of the holder 28, and then wraps around to the spout body 21 side to extend downward.

With respect to the material of the spout 20, at least the attachment 24 is synthetic resin.

As the synthetic resin farming at least the attachment 24 of the spout 20, one may use, for example, polyolefin resin, polyamide resin, polyester resin, (meth)acrylic resin, vinyl chloride resin, vinylidine chloride resin, polyester sulfone, ethylene-vinyl alcohol copolymer, and the like. Among these, polyolefin resin is preferable from the standpoints of excellent forming facility and processing aptitude, as well as low cost.

As polyolefin resin, one may cite, for example, polyethylene resins such as high-density polyethylene, medium-density polyethylene, high-pressure method low-density polyethylene, linear low-density polyethylene, and ethylene-vinyl acetate copolymer; olefin elastomers such as ethylene-α-olefin copolymer; polypropylene resins such as polypropylene, ethylene-propylene random copolymer, and α-olefin-propylene-random copolymer; cyclic polyolefin resin; and so on. These resins may be blended for enhanced performance, and may be partially cross-linked for purposes of enhancing heat resistance or the like. It is preferable that it have the same weldable material as the innermost layer of the laminar film forming the container body 10.

With respect to the spout 20, the entirety of the spout body 21 and the closing portion 22 can be formed with synthetic resin.

(Manufacturing Method)

The method of manufacture of the spouted container is described below. The container body of the spouted container described here relates to a standing bag wherein the film forming the cylindrical body portion 11 and the film forming the bottom 12 described above are welded at the cylindrical inner surface of the body portion 11 and the two side surfaces of the bottom 12, with use of joining members which have heat sealing properties on both sides, thereby welding the mated inner surfaces of the films of the body portion 11 and the bottom 12 at the lower end. However, the method of manufacture of the spouted container of the present invention is not limited to the following method.

Figure 8:
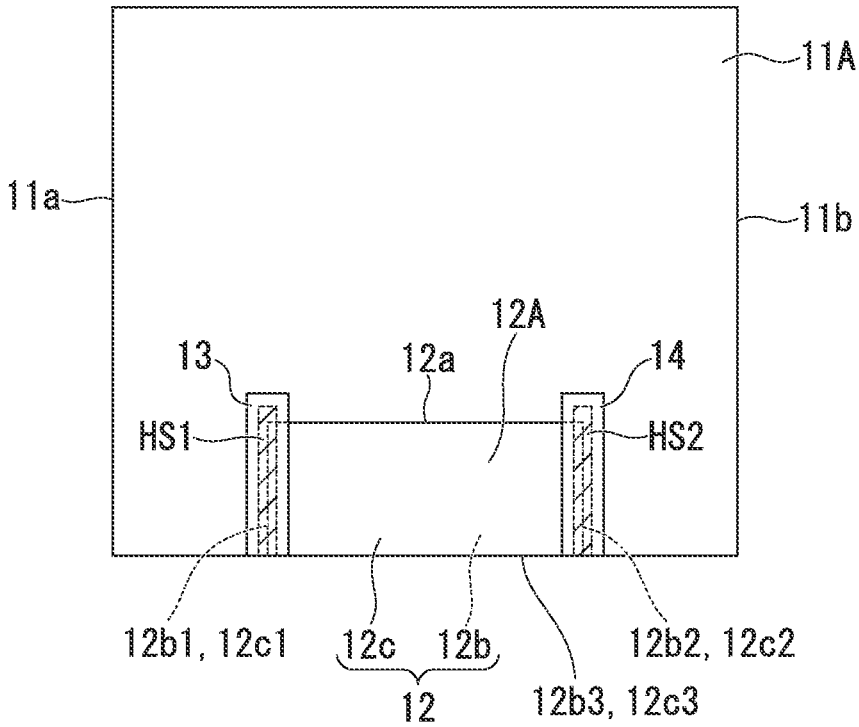
FIG. 8 is a plan view which shows one step in the method of manufacture of the spouted container of the present invention.

As shown in FIG. 8, laminar film 12A forming the bottom 12 is center-folded so that the sealant layer is to the front, and is disposed to overlap the laminar film 11A that forms the sealed portion 30 and the body portion 11 of the container body 10 so that the mated sealant layers oppose each other, and so that the center-folded folding line 12*a* is above. The laminar film 12A is disposed in a folded manner so that, in the laminar film 12A, a side end 12*b*1 of a first bottom face 12*b* which is on one side bordered by the folding line 12*a* and a side end 12*c*1 of a second bottom face 12*c* which is on the other side overlap, a side end 12*b*2 of the first bottom face 12*b* and a side end 12*c*2 of the second bottom face 12*c* overlap, and further a lower end 12*b*3 of the first bottom face 12*b* and a lower end 12*c*3 of the second bottom face 12*c* overlap at the lower end of the laminar film 11A.

Next, in the laminar film 12A atop the laminar film 11A, a bonding member 13 is overlaid onto the side ends 12*b*1, 12*c*1, and a bonding member 14 is overlaid onto the side ends 12*b*2, 12*c*2.

Subsequently, in the heat sealed portion HS1, the laminar film 11A, the laminar film 12A, and the bonding member 13 are welded by heat sealing. Similarly, in the heat sealed portion HS2, the laminar film 11A, the laminar film 12A, and the bonding member 14 are welded by heat sealing.

Thereafter, the mated side ends 11*a*, 11*b* of the laminar film 11A are abutted, and the body portion 11 is formed by heat sealing these to the bonding member. Furthermore, the lower end of the body portion 11 and the lower ends 12*b*3, 12*c*3 of the laminar film 12A are heat sealed along the entire length in the circumferential direction.

Figure 9:
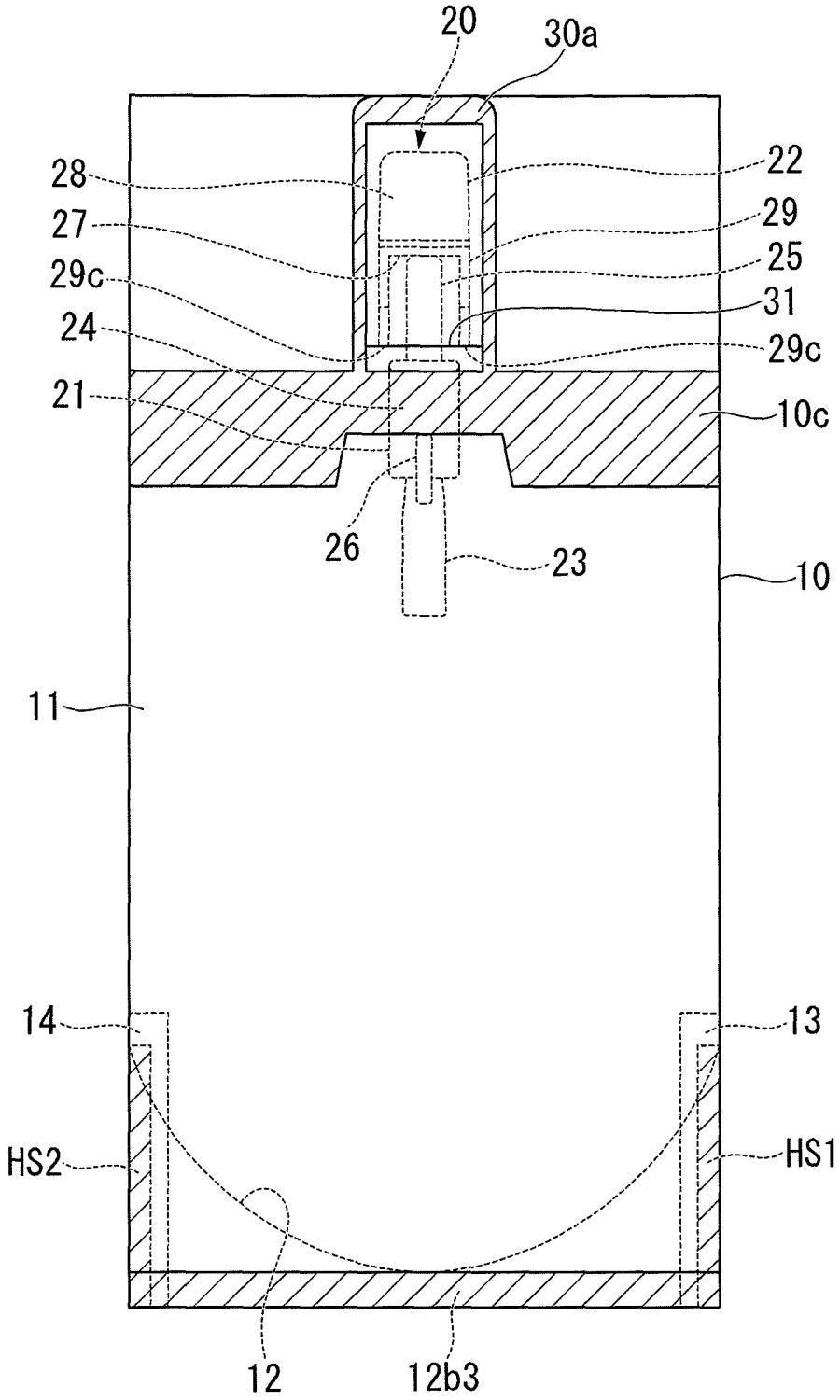
FIG. 9 is a front elevation view which shows one step in the method of manufacture of the spouted container of the present invention.

Subsequently, as shown in FIG. 9, the spout 20 is inserted from the top of the body portion 11. When the entirety of the spout 20 has been inserted into the body portion 11, the attachment 24 of the spout 20 is sandwiched by the film of the body portion 11 corresponding to the attachment 24, the upper part of the body portion 11 is heat sealed and welded in a liquid-tight manner as the upper seal 10*c*, and the body portion 11 and the attachment 24 of the spout 20 are welded in a liquid-tight manner. Subsequently, the periphery of the closing portion 22 and the outer cylinder 25 of the spout 20 are welded in a liquid-tight manner as a peripheral seal 30*a*. The two ends of the peripheral seal 30*a* are coupled to the upper seal 10*c*. The spouted container is then obtained by finally forming the weakened line 31 by cutting the outer sides of the upper seal 10*c* and the peripheral seal 30*a*.

With respect to the content filling method, there is a method which conducts filling prior to spout insertion, a method which unseals a portion of the upper seal 10*c*, and then conducts filling, etc. In addition, the weakened line 31 may be provided in the laminar film 11A prior to formation of the body portion 11, or it may be provided prior to cutting the outer sides of the upper seal 10*e* and the peripheral seal 30*a*.

In contrast to the conventional capped spout, as the spout 20 described above can be manufactured at one time as a single member, cost can be kept low. Moreover, as the spouted container 1 to which the spout 20 is attached seals the closing portion 22 and the outer cylinder 25 of the spout 20 by the sealed portion 30, it has excellent hygienic properties. By imparting barrier properties to the material of the film that forms the sealed portion 30, the spouted container 1 is able to prevent penetration of water vapor and oxygen even into the spout 20, and the thin-walled portion 25*a* of the spout in particular. Furthermore, as the outer cylinder 25 of the spout 20 is exposed by unsealing of the sealed portion 30 in conjunction with snap-off of the closing portion 22 of the spout 20, it is possible to easily expose the discharge port 21*b* at one time by a single action.

The spout and spouted container of the present invention are not limited to the above-described spout 20 and spouted container 1.

For example, the container body of the spouted container is not limited to one that makes film into bag form as described above, and a container such as a bottle or PET bottle is also acceptable. In this case, it is sufficient if the attachment of the spout has a form that enables attachment in a liquid-tight manner to the mouth of the bottle or PET bottle, e.g., a helical concavoconvexity may be formed on the surface of the attachment to enable threadable mounting, or the attachment may be given a cap form to enable threadable mounting.

In addition, the sealed portion which seals the outer cylinder and closing portion of the spout is not limited to a morphology which forms the above-described container body 10 shown by the spouted container 1. For example, in the case where a bottle or PET bottle or the like is used as the container body as mentioned above, a morphology is acceptable wherein a film which forms only the sealed portion is prepared separately from the container body, and the lower end of the sealed portion is welded to the spout body itself in a state where the outer cylinder and the closing portion have been sealed by making the aforementioned film into bag form.

Moreover, with respect to the spout of the present invention, a spout body which lacks the above-described insert is also acceptable.

INDUSTRIAL APPLICABILITY

According to the spout of the present invention, a spout is obtained which attaches to a container body, which is inexpensive, which has excellent hygienic properties, and which facilitates exposure of a discharge port. Moreover, according to the spouted container of the present invention, cost is low, hygienic properties and barrier properties are excellent, and a discharge port can be easily exposed at one time by a single action.

DESCRIPTION OF THE REFERENCE NUMERALS

1 spouted container, 10 container body, 11 body portion, 12 bottom, 20 spout, 21 spout body, 21*a* flow-through portion, 21*b* discharge port, 22 closing portion, 23 insert, 24 attachment, 25 outer cylinder, 26 aperture, 29 projection, 29*c* distal end of projection, 30.

The invention claimed is:

1. A spouted container, comprising:

a container body which stores contents;

a spout which is attached to said container body; and a sealed portion which seals a portion positioned outer side of said spout with a bag-like film, wherein the spout comprises:

a spout body which discharges contents from the container body; and a closing portion which closes a discharge port of the spout body, wherein the spout body has an attachment that is attached to the container body in a liquid-tight manner, and an outer cylinder which has a discharge port, wherein the outer cylinder of the spout body and the closing portion are disposed inside the sealed portion, wherein the closing portion of the spout comprises:

a closing body coupled to the discharge port of the outer cylinder so as to be capable of being snapped off; and a projection extending from the closing body toward the attachment of the spout body, and wherein a weakened line, which is severed by a distal end of the projection of the closing portion to unseal said sealed portion so as to expose the outer cylinder of said spout body when the closing portion is snapped off from the outer cylinder, is formed at a position corresponding to distal ends of projections of said closing portion in said sealed portion.

* * * * *